US006098356A

United States Patent [19]

Sorkin

[11] Patent Number: 6,098,356

[45] **Date of Patent: *Aug. 8, 2000**

[54] METHOD AND APPARATUS FOR SEALING AN INTERMEDIATE ANCHORAGE OF A POST-TENSION SYSTEM

[76] Inventor: Felix L. Sorkin, 4115 Greenbriar Dr., P.O. Box 1503, Stafford, Tex. 77477

[ * ] Notice: This patent is subject to a terminal disclaimer.

[21] Appl. No.: 09/185,132

[22] Filed: Nov. 3, 1998

Related U.S. Application Data

[60] Provisional application No. 60/099,990, Sep. 11, 1998.

[51] Int. Cl.[7] ..... E04C 5/12

[52] U.S. Cl. ..... 52/223.13; 52/223.6; 24/122.6; 24/459; 24/464

[58] Field of Search ..... 52/223.13

[56] References Cited

U.S. PATENT DOCUMENTS 4,719,658 1/1988 Kriofske ..... 52/223

4,896,470 1/1990 Sorkin ..... 52/230

5,749,185 5/1998 Sorkin ..... 52/223.13

*Primary Examiner*—Carl D. Friedman

*Assistant Examiner*—Patrick J. Chavez

*Attorney, Agent, or Firm*—Harrison & Egbert

[57] ABSTRACT

An apparatus for sealing an intermediate anchorage of a post-tension anchor system having a cap with an attachment section thereon. The attachment section is adapted to allow the cap to be connected to an end of the anchor body. The cap has a tubular member extending outwardly from the attachment section. The tubular member has an opening at an end opposite the attachment section. The cap has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

16 Claims, 2 Drawing Sheets

METHOD AND APPARATUS FOR SEALING AN INTERMEDIATE ANCHORAGE OF A POST-TENSION SYSTEM

RELATED APPLICATIONS

The present application is based on U.S. Provisional Patent Application Ser. No. 60/099,990, filed on Sep. 11, 1998, and entitled "Method and Apparatus for Sealing an Intermediate Anchorage of a Post-Tension System", presently pending.

TECHNICAL FIELD

The present invention relates to post-tensioning systems. More particularly, the present invention relates to post-tensioning systems having intermediate anchorages. Furthermore, the present invention relates to sealing devices for preventing liquid intrusion into the exposed sections of tendon in the post-tension system.

BACKGROUND ART

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete maybe constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

There are many post-tension systems employing intermediate anchorages where the length of the slab is too long to tension with a single anchor. In these systems, the intermediate anchor is interposed between a live end and a dead end anchor. In the construction of such intermediate anchorage systems, the tendon extends for a desired length to the intermediate anchor. A portion of the sheathing is removed in the vicinity of the intermediate anchor. The intermediate anchor is installed onto a form board in accordance with conventional practice. The unsheathed portion of the tendon is received by a tensioning apparatus such that the tendon is stressed in the area between the dead end anchor and the intermediate anchor. After stressing the tendon, concrete is poured over the exterior of the sheathed tendon and over the dead end anchor and intermediate anchor. The remaining portion of the tendon extends from the intermediate anchor to either another intermediate anchorage or to the live end anchor. Intermediate anchorage systems are employed whenever the slab is so long that a single live anchor extending to a single dead end anchor is inadequate. For example, two intermediate anchorages would be used for slabs having a length of approximately 300 feet.

A problem that affects many of the intermediate anchorage systems is the inability to effectively prevent liquid intrusion into the unsheathed portion of the tendon. Normally, the unsheathed portion will extend outwardly, for a distance, from the intermediate anchor in the direction toward the dead end anchor. Additionally, another unsheathed portion will extend outwardly at the intermediate anchor toward the live end anchor. In normal practice with a single live anchor and without intermediate anchors, a liquid-tight tubular member is placed onto an end of the anchor so as to cover the unsheathed portion of the tendon. This is relatively easy to accomplish since the length of the tendon is minimal at the live end. However, it is a considerable burden to attempt to slide such a tubular member along the entire length of the tendon so as to form the liquid-tight seal at the intermediate anchorage. In normal practice, tape, or other corrosion protection materials, are applied to the exposed portion of the tendon adjacent the intermediate anchorage. Extensive practice with this technique has shown that it is generally ineffective for preventing liquid intrusion into the interior of the tendon or into the interior of the intermediate anchorage. As such, a great need has developed in which to protect the exposed areas of the tendon adjacent the intermediate anchorage.

It is an object of the present invention to provide an intermediate anchorage for a post-tension system which facilitates an effective seal over the exposed portions of the tendon at the intermediate anchorage.

It is a further object of the present invention to provide a sealing mechanism for attachment to the intermediate anchorage which prevents liquid intrusion.

It is a further object of the present invention to provide a sealing apparatus which is easy to install and easy to use.

It is a further object of the present invention to provide a sealing apparatus which is easy to manufacture and relatively inexpensive.

These and other objects and advantages of the present invention will become apparent from a reading of the attached specification and appended claims.

SUMMARY OF THE INVENTION

The present invention is an apparatus for sealing an intermediate anchorage of a post-tension anchor system comprising a cap having an attachment section thereon. The attachment section is adapted to allow the cap to be connected to the end of an anchor body. The cap has a tubular member extending outwardly from the attachment section. The tubular member has an opening at an end opposite the attachment section. The cap has a grease fitting formed thereon. The grease fitting is adapted to allow greased to be introduced into the interior passageway of the tubular member. The attachment section is of an annular configuration. The attachment section is coaxial with the tubular member. The grease fitting extends transverse to a longitudinal axis of the tubular member. The tubular member has a member has a means at the open end so as to form a liquid-tight seal with the sheathing of a tendon extending therethrough. The attachment section and the tubular member are integrally formed together of a polymeric material.

The present invention is also a post-tension anchor system which comprises an anchor body, a tendon affixed to the anchor body and having an unsheathed portion extending outwardly from the anchor body, and a cap affixed to the anchor body. The cap has a tubular member extending outwardly from the anchor body. The tubular member of the cap extends over the unsheathed portion of the tendon. The tubular member has an open end opposite the anchor body. The open end is positioned over the sheathed portion of the tendon. The cap has a grease fitting formed thereon. This grease fitting is adapted so as to allow grease to be placed within the tubular member and over the unsheathed portion of the tendon. A sealing means is affixed to the open end of the cap. The sealing means serves to form a liquid-tight seal between the open end of the tubular member and the sheathed portion of the tendon. The present invention is also a method of encapsulating an unsheathed portion of a tendon in an intermediate anchorage of a post-tension anchor system. This method includes the steps of: (1) affixing the tendon within the intermediate anchorage such that an unsheathed portion extends outwardly of the anchorage; (2) attaching a cap to the intermediate anchorage such that the cap has a tubular member extending over the unsheathed portion; and (3) injecting grease into the cap so as to fill the space between a wall of the tubular member and an exterior surface of the unsheathed portion of the tendon. The method of the present invention further includes the step of sealing the open end of the cap onto a sheathed portion of the tendon so as to retain the grease interior of the tubular member.

DETAILED DESCRIPTION OF THE INVENTION

Figure 1:
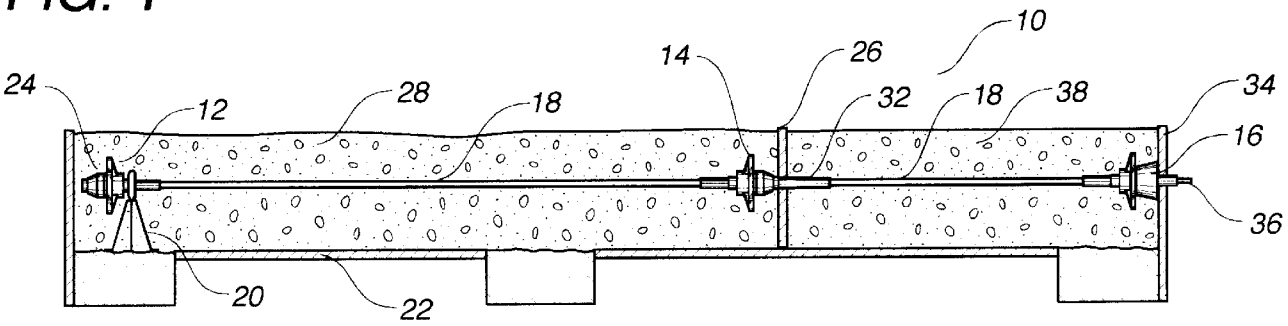
FIG. 1 is a side elevational view, in partial cross-section, which shows the configuration of an intermediate anchorage in a post-tension system.

In FIG. 1, there is shown at 10 the post-tensioning system anchorage system in accordance with the teachings of the present invention. The post-tensioning system 10 includes a dead end anchor 12, an intermediate anchor 14 and a live end anchor 16. A tendon 18 extends from the dead end anchor 12 through the intermediate anchor 14 and into the live end anchor 16. The dead end anchor 12 is supported on a chair 20 above a slab 22 for a desired distance. The end 24 of the tendon 18 is fixed into the dead end anchor 12. The tendon 18 is a sheathed tendon which extends from the dead end anchor 12 through the intermediate anchor 14. The intermediate anchor 14 is mounted on a frame 26 so as to support the intermediate anchor 14 a desired distance above the floor or slab 22.

The tendon 18 is initially tensioned in the area between the intermediate anchor 14 and the dead end anchor 12. Suitable wedges are applied into the interior passageway of the intermediate anchor 14 so as to retain the tendon 18 in its stressed condition. Concrete 28 can then be poured over the stressed tendon 18. The tubular corrosion protection cap 32 extends over the exposed unsheathed portion of the tendon 18 which extends outwardly into the area between the intermediate anchorage 14 and the live end anchorage 16.

The live end anchor 16 is mounted on another frame 34 so as to support the live end anchor 16 a desired distance above the floor or slab 22. The end 36 of the tendon 18 will extend outwardly on an opposite side of the frame 34. The end 36 of the tendon 18 can then be stressed so as to tension the tendon 18 in the area between the intermediate anchor 14 and the live end anchor 16. In normal practice, this will cause the exposed portion of the tendon 18 to extend further outwardly of the intermediate anchor 14. As such, the tubular corrosion protection cap 32 should have a sufficient length so as to accommodate the tensioning of the tendon 18. Concrete 38 is then poured into the area between the intermediate anchor 14 and the live end anchor 16.

Figure 2:
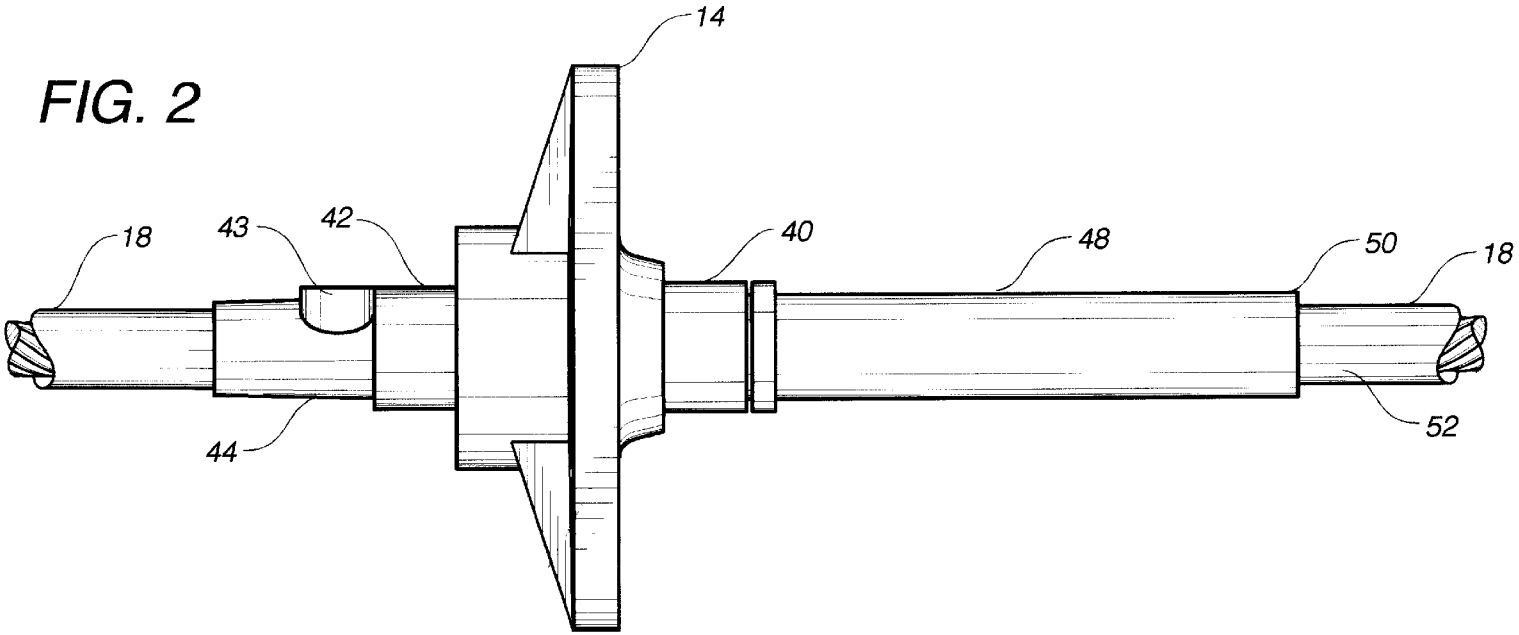
FIG. 2 is a plan view of the first embodiment of the present invention.

FIG. 2 shows the configuration of the intermediate anchor 14 as used in the system of the present invention. The anchor 14 is an encapsulated anchor having a tubular extension 40 extending outwardly from one side of the anchor 14 and a cap 42 extending outwardly from an opposite side of the anchor 14. As can be seen, the tendon 18 extends through the interior passageway of the anchor 14 and through the tubular extension 40 and the tubular opening 42. Importantly, in the present invention, a first tubular member 44 extends over the exposed unsheathed portion of the tendon 18. An end of the first cap tubular member 44 is connected to the cap 42. The cap 42 has a grease fitting 43 which allows grease or a corrosion-resistant liquid to be injected therein. This grease can fill the space between the interior of tubular member 44 and the unsheathed portion of tendon 18.

Similarly, a second tubular member 48 can be affixed into the tubular extension 40 of the anchor 14. The second tubular member 48 will also extend over the unsheathed portion of the tendon 18 and will have the end 50 residing over the sheathed portion 52 of the tendon 18. The interior of the second tubular member 48 is slidably received, in liquid-tight relationship, into the interior of the tubular extension 40. As can be seen, the relatively long lengths of the tubular members 44 and 48 assure that the exposed portions of the tendon 18 are protected from exposure to the exterior elements. The lengths also assure that such protection will continue even though the tendon 18 is tensioned at an opposite end.

Figure 3:
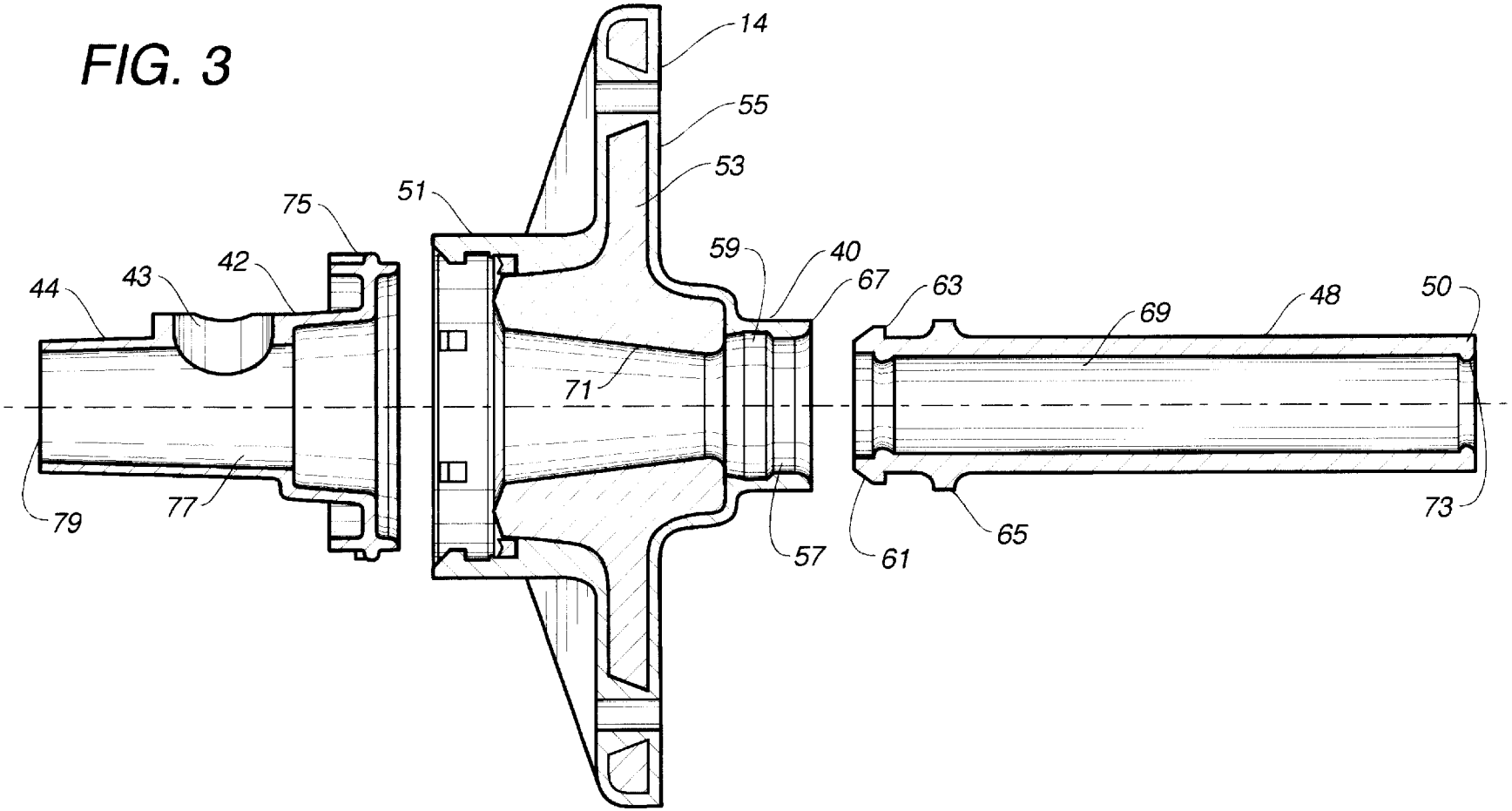
FIG. 3 is a cross-sectional view of the system of the present invention.

As can be seen in FIG. 3, the anchor 14 is a conventional intermediate anchor having a tubular extension 40 at one end and a tubular opening 51 at an opposite end. The steel anchor body 53 is encapsulated with a polymeric encapsulation 55. The tubular extension 40 has an interior passage 57 having a groove 59. The groove 59 is suitable for the receipt of the spearhead-shaped end 61 of the tubular member 48. The end 63 of the spearhead-shaped end 61 will reside against a shoulder forming an edge of the first groove 59. An annular section 65 extends around the tubular member 48 and will reside in abutment with the end 67 of the tubular extension 40. As such, the interior passageway 69 of the tubular extension 48 will reside in coaxial alignment with the wedge-receiving cavity 71 of the anchor 14. The opposite end 50 of the tubular member 48 has a sealing portion 73 formed therein so as to establish a liquid-tight contact with the sheathed portion of the tendon. The unsheathed portion of the tendon will extend through the interior of the tubular member 48. The unsheathed portion is secured in position by wedges and the interference fit of the wedges with the wedge-receiving cavity 71.

The cylindrical opening 51, at the opposite end of the anchor 14, is suitably configured so as to receive the attachment section 75 of the cap 42. The attachment section 75 is suitable for snap-fit receipt within the interior of this cylindrical opening 51 of anchor 14. The cap 42 has an interior passageway 77 extending therethrough so as to emerge at end 79 of the tubular member 44. Another tubular member can wrap around the exterior of the tubular member 44 or the end 79 can otherwise be secured in sealing contact with the sheathed portion of the tendon extending therethrough. The grease fitting 43 is provided on the exterior of the cap 42 so as to facilitate the introduction of grease, or other corrosion-resistant liquid, into the interior passageway 77. When a suitable amount of such grease is inserted through the grease fitting 43, then the unsheathed portion of the tendon will be suitably encapsulated by the grease so that water intrusion is effectively prevented. The grease will fill the interior passageway 77 of the cap 42 and also fill the area within the cylindrical portion 51 of the anchor 14 adjacent to the wedge-receiving cavity 71.

In the present invention, the tubular member 44 and the attachment section 75 are integrally formed together of a polymeric material. The grease fitting 43 is a grease zerk which can be attached to the tubular member 44. The grease zerk 43 will extend transverse to the longitudinal axis of the tubular member 44. It can be seen in FIG. 3 that the attachment section 75 has an annular configuration which is coaxial to the tubular member 44. The attachment section 75 is suitable for "snap fit" engagement with the cylindrical opening 51 of the anchor 14. In normal use, grease will fill the area between the inner wall of the tubular member 44 and the exterior surface of the unsheathed portion of the tendon extending therethrough.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An apparatus for sealing an intermediate anchorage of a post-tension anchor system comprising:

a cap having an attachment section at one end thereof, said attachment section adapted to allow said cap to be connected to an end of an anchor body, said cap having a tubular member extending outwardly from said attachment section, said tubular member having an open end opposite said attachment section, said tubular member having a grease fitting formed thereon away from said open end, said grease fitting adapted to allow grease to be introduced into an interior passageway of said tubular member, said attachment section and said tubular member being integrally formed together of a polymeric material.

2. The apparatus of claim 1, said attachment section being of an annular configuration, said attachment section being coaxial with said tubular member.

3. The apparatus of claim 1, said grease fitting extending transverse to a longitudinal axis of said tubular member.

4. The apparatus of claim 3, said grease fitting being a grease zerk.

5. The apparatus of claim 1, said tubular member having means at said end for forming a liquid-tight seal with a sheathing of a tendon extending therethrough.

6. A post-tension anchor system comprising:

an anchor body;

a tendon affixed to said anchor body, said tendon having an unsheathed portion extending outwardly from said anchor body, said tendon having a sheathed portion at an end of said unsheathed portion opposite said anchor body; and a cap affixed to said anchor body, said cap having an integral tubular member extending outwardly from said anchor body, said tubular member of said cap extending entirely over said unsheathed portion, said tubular member having an open end opposite said anchor body, said open end positioned over said sheathed portion of said tendon, said tubular member having a grease fitting formed thereon, said grease fitting adapted so as to allow grease to be placed within said tubular member and over said unsheathed portion.

7. The system of claim 6, further comprising:

a sealing means affixed to said open end, said sealing means for forming a liquid-tight seal between said open end and said sheathed portion of said tendon.

8. The system of claim 6, said anchor body comprising:

an anchor member having a wedge-receiving cavity formed therein, said wedge-receiving cavity being tapered so as to have a wide end adjacent said cap said tendon extending through and affixed within said wedge-receiving cavity; and a polymeric encapsulation affixed over said anchor member, said polymeric encapsulation having a cylindrical opening formed thereon at said wide end of said wedge-receiving cavity, said cap having an attachment section in engagement with said cylindrical opening.

9. The system of claim 8, said attachment section being in snap-fit relationship with said cylindrical opening.

10. The system of claim 8, said attachment section having a greater diameter than a diameter of said tubular member.

11. The system of claim 10, said attachment section being coaxial with said tubular member.

12. The system of claim 8, said tubular member and said attachment section being integrally formed together of a polymeric material.

13. The system of claim 6, said grease fitting being a grease zerk affixed to said tubular member.

14. The system of claim 6, further comprising:

a grease filling a volume between a wall of said tubular member and an exterior surface of said unsheathed portion.

15. A method of encapsulating an unsheathed portion of a tendon in an intermediate anchorage of a post-tension anchor system comprising:

forming the intermediate anchorage with a polymeric encapsulation surrounding a steel anchor member, said anchor member having a tapered wedge-receiving cavity formed therein, said cavity having a wide end at one end of said anchor member, said polymeric encapsulation having a cylindrical opening extending outwardly of said one end from said anchor member;

affixing the tendon within said wedge-receiving cavity of the intermediate anchorage such that the unsheathed portion extends outwardly of said one end of said anchor member;

attaching a cap to said cylindrical opening such that the cap has a tubular member extending over the unsheathed portion, said tubular member having an open end opposite said cylindrical opening, said tendon having a sheathed portion extending through said open end;

sealing said open end onto said sheathed portion of the tendon; and injecting grease into said cap through a wall of said tubular member to fill a space between said wall of said tubular member and an exterior surface of said unsheathed portion of the tendon.

16. The method of claim 15, further comprising the steps of:

forming the cap so as to have an attachment section integrally connected to said tubular member, said attachment section and said tubular member being of a polymeric material; and attaching a grease zerk to said tubular member.

* * * * *